United States Patent [19]

Burcenski

[11] 4,111,422

[45] Sep. 5, 1978

[54] LAWN GAME DEVICE WITH SWUNG LAUNCHING STICK

[76] Inventor: Michael J. Burcenski, 318 E. 12th St., Lockport, Ill. 60441

[21] Appl. No.: 748,818

[22] Filed: Dec. 9, 1976

[51] Int. Cl.[2] ..... A63B 63/02; A63B 67/00

[52] U.S. Cl. ..... 273/101; 273/105 R; 124/5; 273/106.5 B; 273/106.5 C; 273/129 A

[58] Field of Search ..... 273/106 R, 106.5 R, 273/106.5 B, 106.5 C, 106 E, 129 A, 129 B, 129 D, 129 HB, 129 R, 101, 102 R, 105 R, 95 R, 95 F; 124/17.5

[56] References Cited

U.S. PATENT DOCUMENTS

| | | | |
|---|---|---|---|
| 935,455 | 9/1909 | Bartholomew et al. | 273/129 D |
| 1,038,429 | 9/1912 | Penny | 273/129 A |
| 1,374,420 | 4/1921 | Berggreen | 273/106.5 R |
| 1,989,484 | 1/1935 | Maryfield et al. | 273/102 R |
| 2,079,937 | 5/1937 | Harris | 273/106.5 R |
| 2,621,441 | 12/1952 | Worden | 273/106 E |
| 2,642,289 | 6/1953 | Gersmeal | 273/106.5 R |
| 3,014,308 | 12/1961 | Parris | 273/101 |
| 3,052,226 | 9/1962 | Woll | 273/129 A |
| 3,147,011 | 9/1964 | Lemelson | 273/106.5 R |
| 3,216,727 | 11/1965 | Hunter | 273/106.5 R |
| 3,218,755 | 11/1965 | Quercetti | 124/17 |
| 3,312,471 | 4/1967 | Nissen | 273/105 R |
| 3,851,880 | 12/1974 | Ritch | 273/129 A |

FOREIGN PATENT DOCUMENTS

| | | | |
|---|---|---|---|
| 589,556 | 12/1959 | Canada | 273/95 F |

*Primary Examiner*—Richard C. Pinkham
*Assistant Examiner*—Lawrence E. Anderson
*Attorney, Agent, or Firm*—Clarence A. O'Brien; Harvey B. Jacobson

[57] ABSTRACT

A lawn game device including targets and a plurality of missiles or projectiles launched or projected toward the targets by the use launching sticks swung by the players somewhat in the nature of swinging a golf club or hockey stick with the missiles being supported in launching position by a cradle tee. Each target is in the form of an annular member of frustoconical configuration supported generally in an upright condition from the ground surface. Each missile is in the form of a cylindrical member having a rounded nose, stabilizing vanes at the rear thereof and a plurality of rearwardly and outwardly inclined hooks adjacent the forward end thereof for engagement by a launching stick. The launching stick includes an elongated handle with a downwardly opening arch at the lower end thereof with a resilient band extending across the open end of the arch to engage the hooks on the missile. The cradle tee is in the form of a pointed ground inserted peg or stake having a generally semi-circular cradle at the upper end thereof for supporting the cylindrical missile at a point adjacent the forward end thereof.

3 Claims, 6 Drawing Figures

LAWN GAME DEVICE WITH SWUNG LAUNCHING STICK

BACKGROUND OF THE INVENTION

1. Field of the Invention

The present invention generally relates to a game device and more particularly a lawn game device incorporating ring-like targets, missile-like projectiles supported in inclined relation by cradle tees and launched toward the target by a launching stick swung by a player and including a resilient band or strap engageable with the projectile for lifting it from the tee and projecting it in a trajectory toward the target.

2. Description of the Prior Art

Various types of lawn game devices have been devised in which game pieces, such as projectiles in the form of balls, and other devices, are launched towards a target or targets by a player or players by the use of some type of club, racket, mallet, or the like. Also, game devices simulative of golf are well known. The following U.S. Patents disclose devices exemplary of the development in lawn game devices:

Patent Nos. 3,114,555 — Dec. 17, 1963
3,128,627 — Apr.14, 1964
3,142,488 — July 28, 1964
3,222,931 — Dec.. 14, 1965
3,761,087 — Sep. 25, 1973
3,885,795 — May 27, 1975.

SUMMARY OF THE INVENTION

An object of the present invention is to provide a lawn game device which includes a unique target, missile or projectile, cradle tee and launching stick with the number of such components provided being variable depending upon the number of players to play the game and the lawn area available with it being preferred that at least two targets be provided along with two launching sticks and four missiles and two cradle tees.

Another object of the invention is to provide a lawn game device in accordance with the preceding object in which each target is in the form of an annular member having a ground inserted stake or peg secured thereto to support the annular member in a generally vertical but slightly inclined position with the shape of the annular member being substantially frustoconical.

A further object of the invention is to provide a lawn game device in accordance with the preceding objects in which each missile is in the form of a cylindrical member having a rounded nose of resilient material at the forward end and stabilizing vanes projecting radially and longitudinally from the rear portion thereof and a plurality of outwardly and rearwardly inclined hook forming members adjacent the nose to enable the missile to be engaged and held by a launching stick.

Still another object of the present invention is to provide a lawn game device in accordance with the preceding objects in which the launching stick is in the form of an elongated shank or handle, generally simulative of a golf club or hockey stick, having a downwardly opening arch at the lower end thereof and a resilient band or strip across the open end of the arch for engagement with one of the hook forming members on the missile so tht the missile is projected toward the target in a desired path when the arch on the launching stick is swung in an arcuate path, the rigid upper portion of the arch will pass over the missile without engagement with the hook-like projections and the resilient band will engage with the hook-like projections.

Still another feature of the present invention is to provide a lawn game device in accordance with the preceding objects in which the missiles are supported by cradle tees in the form of ground inserted pegs hving an upwardly opening semi-circular or U-shaped cradle at the upper end and provided with multicolored streamers, or the like, attached to the rear portion thereof to further stabilize the path of the missiles and to enable easier observation thereof, with the game device being capable of use in a relatively small lawn area, and capable of being used by players of various ages to not only provide entertainment and exercise but also to develop skills, coordination, and the like.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Referring now specifically to the drawings, the lawn game device of the present invention includes a target or targets generally designated by numeral 10, a missile or missiles generally designated by numeral 12 with a cradle tee generally designated by numeral 14 supporting the missile and the missile being projected by a launching stick generally designated by numeral 16.

Figure 2:
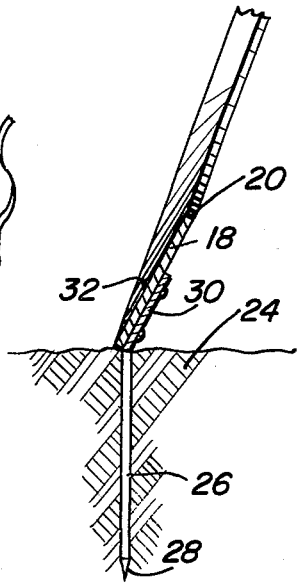
FIG. 2 is a detailed sectional view on an enlarged scale taken substantially upon a plane passing along section line 2—2 of FIG. 1 illustrating the specific structure of the target and the manner of supporting it from the ground surface.

The target 10 includes an annular member or ring-like member 18 which defines the frustum of a cone, that is, the surface of the annular member 18 is inclined as illustrated in FIG. 2 from a central enlarged opening 20 to a peripheral edge 22. The target 10 is supported in a generally upright position from the ground surface 24 by a ground inserted stake or peg 26 having a pointed lower end 28. The upper end of the ground stake 26 is provided with an inclined plate 30 secured to the surface of the annular member 18 by fastening devices such as rivets 32 or any other suitable securing means which will fixedly interconnect the stake 26 and the annular member 18. As illustrated in FIG. 2, the annular member 18 is supported in inclined relation to a vertical plane passing through the stake 26 so that it will be generally perpendicular to the path of trajectory of the missile 12.

Figure 1:
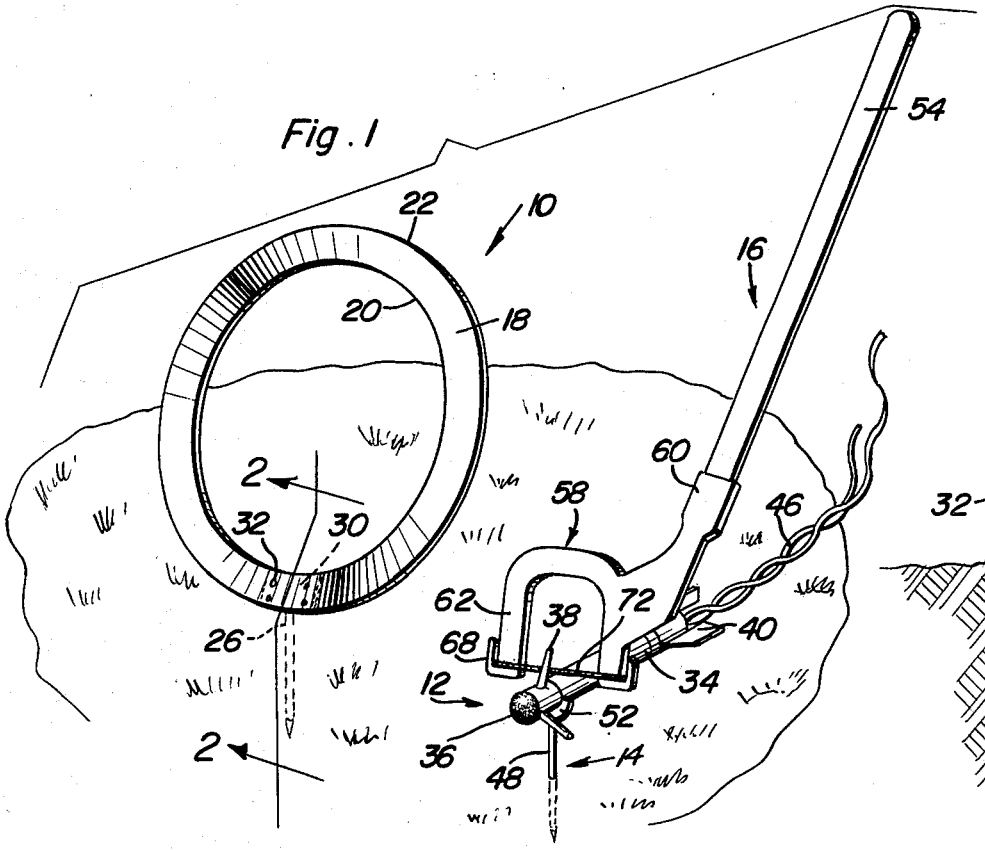
FIG. 1 is a group perspective view of the lawn game device of the present invention illustrating the components in an adjacent relationship with it being pointed out that the target would normally be removed from the missile and launching stick.

The missile 12 includes an elongated cylindrical member 34 having a rounded nose 36 at the forward end thereof with the nose 36 being constructed of rubber or other resilient material which may be either solid or hollow and generally is in the nature of the rubber nose employed on a shuttle cock. A plurality of outwardly and rearwardly inclined pins or rods 38 are secured to the cylindrical member 34 adjacent the nose 36 and these rods or pins 38 coact with the cylindrical member 34 to form a hook-like projection so that the missile can be engaged by the launching stick 16 in a manner described hereinafter. There are three rods or pins 38 evenly distributed peripherally of the cylindrical member 34 and when the missile 12 is supported from the cradle tee 14, one of the rods 38 defining a hook-like projection is located uppermost as illustrated in FIG. 1. The rear of the cylindrical member 34 is provided with three equally spaced, radical vanes 40 which extend longitudinally behind the cylindrical member 34 and provided with an inclined leading edge 42 and a straight, radial trailing edge 44. The vanes 40 are in alignment with the projecting rods 38 so that when the missile 12 is supported in the cradle tee 14, as illustrated in FIG. 1, two of the vanes 40 will be resting on the ground surface in order to stabilize the missile while resting on the cradle tee and assure that one of the hook-like forming members 38 will be disposed uppermost. Also, the rear of the cylindrical member 34 is provided with a plurality of flexible strips 46 secured thereto which form streamers and which may be constructed of selected colors and preferably are of flexible plastic material. The streamers serve to additionally stabilize the missile in its flight path and enable better observation of the trajectory of the missile.

The cradle tee 14 includes a ground stake or peg 48 having a sharpened lower end 50 and an upwardly opening, semi-circular or U-shaped cradle 52 rigid with the upper end thereof with the internal surface of the cradle 52 generally conforming with the external surface of the cylindrical member 34 so that the cradle 52 may be positioned immediately rearwardly of the hook-like forming members 38, thus supporting the missile 12 in an inclined relation with the forward or nose end thereof above the trailing end so that the missile, when launched by the launching stick 16 will move in an arcuate path of movement toward the target 10.

Figure 3:
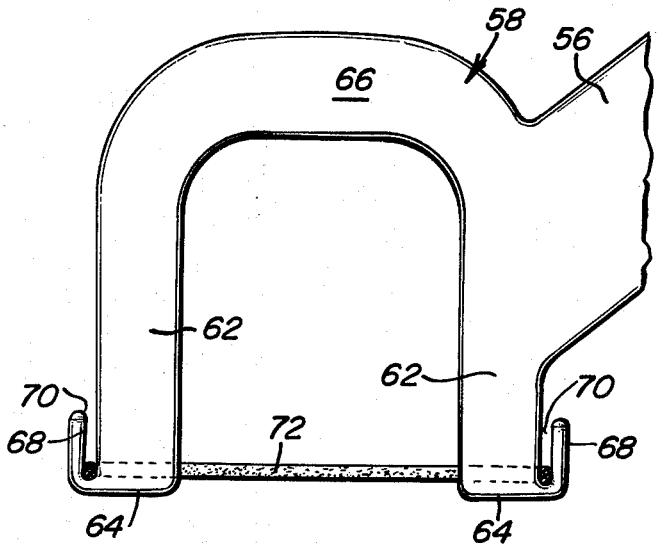
FIG. 3 is an enlarged elevational view of the lower arch portion of the launching stick.
Figure 6:
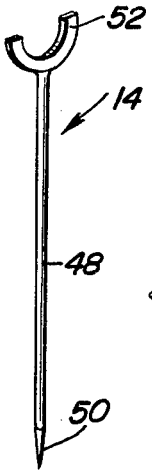
FIG. 6 is a perspective view of the cradle tee.
Figure 5:
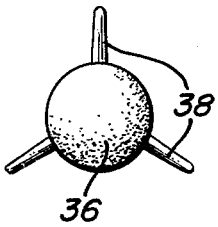
FIG. 5 is a front end elevational view of the missile.
Figure 4:
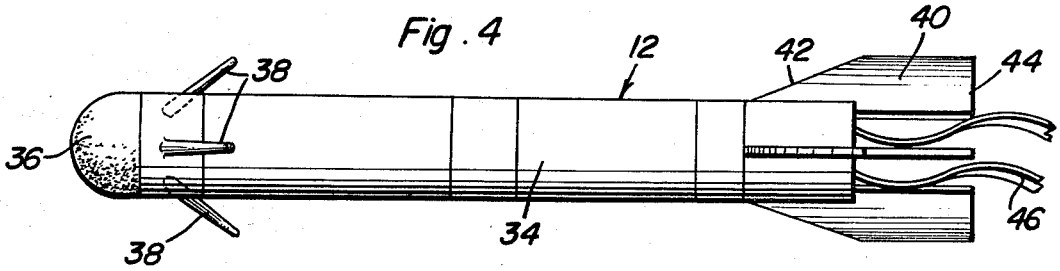
FIG. 4 is a side elevational view of the missile.

The launching stick 16 includes an elongated handle 54 similar to that used in a hockey stick, or the like, which is connected to a lower head 56 having a generally U-shaped arch 58 integral therewith and an attaching socket 60 receiving the lower end of the handle 54. The arch 58 includes a pair of parallel legs 62 which are spaced laterally from each other and terminate in lower free ends 64 with the upper ends of the legs 62 being rigidly interconnected by a bight portion or web 66. The arch 58 as well as the socket 60 is preferably constructed of unitary construction of plastic material, although other materials may be employed. Each leg 62 is provided with a tab or retaining rod 68 extending upwardly from the outer lower end edge thereof, as illustrated in FIG. 2, thus defining an upwardly opening slot or recess 70 for receiving and retaining a rubber band or ribbon 72 which extends transversely between the legs 62 adjacent the free ends 64 thereof as illustrated in FIG. 3. The width of the slot or recess 70 is such that the resilient band or ribbon 72 will be frictionally held therein. The resilient band or ribbon 72 may be in the form of an endless rubber band of a dimension so that it will be stretched to some degree when placed in the slots 70 so that the resiliency of the rubber band will retain it in position and also provide launching force to the missile when the launching stick is swung in an arcuate path generally in the nature of a hockey stick or golf club and the rubber band 72 engaged with the upwardly and rearwardly projecting hook forming member 38 as illustrated in FIG. 1 so that the missile will be launched in a desired path toward the target 10.

The lawn game device will preferably be constructed so that four tubular missiles will be provided along with two launching sticks, two targets and two cradle tees. The various components may be decoratively colored and distinguishably colored so that the launching sticks will be of two different colors and two of the missiles will be the same color as one of the launching sticks and the other missiles be the same color as the other launching stick so that the players may readily distinguish their missiles and launching sticks. The targets are spaced apart at predetermined distances, preferably about 40 feet apart, and the first player places his missiles at the side of one target and uses the launching stick to drive or launch the missiles toward the other target. Scoring can be determined by whether the missile goes through the central opening in the target or depending on which missile lands closest to the target.

While dimensional characteristics of the components may vary, the lawn game device has been successfully utilized in which the target has an outside diameter of approximately 24 inches and an inside diameter or approximately 19 inches with the stake being 5 or 6 inches in length. The annular member may be 2 to 3 inches wide and relatively thin and may be constructed of plastic, waterproof cardboard, or the like, of any suitable color. The cradle tee may have an over-all length of approximately 8 inches and the width of the cradle may be approximately 2 inches. The missile may be tubular or of lightweight solid construction and approximately 13 inches long with a diameter of 1 to 1½ inches. The three hook forming members may be approximately 2 inches in length and the vanes may be 3-½ inches long and 1 to 1-½ inches wide and the streamers may be approximately 18 inches in length. The launching stick handle may be approximately 30 inches long and the width of the arch may be approximately 5 inches. The swinging action of the launching stick should be relatively slow with the major propelling force being accomplished by a wrist snap action. Various materials may be employed in constructing the device with such materials being colored any attractive colors and the components may be packaged in a suitable container for storage and distribution.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a lawn game device, a missile comprising an elongated member having a nose at the forward end thereof and stabilizing vane means at the rear thereof, and a laterally and rearwardly inclined projection on said elongated member adjacent the nose adapted to be engaged by a launching device, a launching stick comprising an elongated handle for manual gripping and swinging, a downwardly opening arch at the lower end of said handle with the arch including parallel, spaced legs, and a resilient band interconnecting the terminal ends of the legs and engaging under the projection during arcuate swinging movement of the launching stick in a path to bring the resilient band into engagement with the projection for projecting the missile in a desired trajectory, and a cradle tee supporting the forward end of the missile above a supporting surface, said tee including a ground stake and a generally U-shaped cradle at the upper end for engagement with said elongated member rearwardly of the projection, a target for the missile comprising an annular member, a ground stake connected to said annular member for insertion into the ground to support the annular member in generally upright position, said annular member being frustoconical in configuration and oriented in inclined relation to a vertical plane so that the opening defining the center of the annular member has its periphery generally perpendicular to the path of trajectory of the missile as it approaches the target.

2. The structure as defined in claim 1 wherein said vane means including three equally spaced, radially extending and longitudinally extending vanes rigid with said elongated member with the trailing ends of the vanes extending rearwardly of said elongated member, and a plurality of flexible streamers attached to said elongated member inwardly of the trailing ends of the vanes and projecting longitudinally behind the vanes, and two additional projections on said elongated member adjacent the nose with the projections being aligned with the vanes, each of said projections being in the form of a rod-like structure which combines with the elongated member to form a hook-like member for engagement by said launching stick.

3. In a lawn game device, a launching stick for launching an inclined, stationary, ground supported projectile having an upwardly extending hook forming element thereon, said launching stick comprising an elongated handle for manual gripping and swinging in an arcuate path in a manner similar to a golf club or hockey stick, said handle having a downwardly opening laterally offset arch at the lower end of said handle, said arch having an open lower end adapted to straddle the projectile as the arch moves toward the hook forming element thereon, said arch including parallel, spaced legs, and having a resilient band interconnecting the terminal ends of said legs and engaging the hook forming element on the projectile for causing the projectile to be launched in an arcuate trajectory.

* * * * *